US007626549B2

(12) United States Patent
Channabasappa

(10) Patent No.: US 7,626,549 B2
(45) Date of Patent: Dec. 1, 2009

(54) COMPACT PLANAR ANTENNA FOR SINGLE AND MULTIPLE POLARIZATION CONFIGURATIONS

(76) Inventor: Eswarappa Channabasappa, 1 Oxbow Dr., Acton, MA (US) 01720

( * ) Notice: Subject to any disclaimer, the term of this patent is extended or adjusted under 35 U.S.C. 154(b) by 159 days.

(21) Appl. No.: 11/692,479

(22) Filed: Mar. 28, 2007

(65) Prior Publication Data

US 2008/0238793 A1 Oct. 2, 2008

(51) Int. Cl.
*H01Q 1/38* (2006.01)

(52) U.S. Cl. ..... 343/700 MS; 343/829; 343/846

(58) Field of Classification Search ..... None
See application file for complete search history.

(56) References Cited

U.S. PATENT DOCUMENTS

| | | | | |
|---|---|---|---|---|
| 5,510,803 | A | 4/1996 | Ishizaka et al. | |
| 6,288,679 | B1 * | 9/2001 | Fischer et al. | 343/700 MS |
| 6,392,600 | B1 | 5/2002 | Carson et al. | |
| 6,717,549 | B2 | 4/2004 | Rawnick et al. | |
| 6,861,988 | B2 | 3/2005 | Gabriel et al. | |
| 6,956,536 | B2 * | 10/2005 | Lee | 343/793 |
| 6,995,709 | B2 | 2/2006 | Spittler | |
| 7,012,569 | B2 * | 3/2006 | Gottwald et al. | 343/700 MS |
| 7,091,907 | B2 * | 8/2006 | Brachat | 343/700 MS |
| 7,307,587 | B2 * | 12/2007 | Eom et al. | 343/700 MS |
| 2001/0043157 | A1 * | 11/2001 | Luk et al. | 343/700 MS |
| 2003/0076259 | A1 | 4/2003 | Zhang | |
| 2004/0239565 | A1 | 12/2004 | Brachat | |
| 2005/0110685 | A1 | 5/2005 | Frederik du Toit | |
| 2005/0190106 | A1 | 9/2005 | Anguera Pros et al. | |
| 2005/0219123 | A1 | 10/2005 | Hansen et al. | |
| 2008/0218417 | A1 * | 9/2008 | Gillette | 343/700 MS |

FOREIGN PATENT DOCUMENTS

| | | |
|---|---|---|
| DE | 102 44 206 A1 | 3/2004 |
| WO | WO 99/31757 | 6/1999 |

OTHER PUBLICATIONS

Wong, H., et al., Design of Dual-Polarized L-Probe Patch Antenna Arrays with High Isolation, IEEE Transactions on Antennas and Propagation, vol. 52, No. 1, Jan. 2004, pp. 45-52.

Waterhouse, R.B., et al., Broadband Printed Millimeter-Wave Antennas, IEEE Transactions on Antennas and Propagation, vol. 51, No. 9, Sep. 2003, pp. 2492-2495.

Targonski, D., et al., "Design of Wide-Band Aperture-Stacked Patch Microstrip Antennas," IEEE Transactions On Antennas and Propagation, vol. 46, No. 9, Sep. 1998, pp. 1245-1251.

(Continued)

*Primary Examiner*—Trinh V Dinh

(57) ABSTRACT

A planar antenna comprising a signal path for receiving or transmitting a signal, a conductive layer having a slot formed therein positioned to electromagnetically couple with the signal path, a conductive plate parallel to and overlying the slot and spaced therefrom by a dielectric layer, the conductive plate being electrically in contact with the signal path, and one or more patches parallel to and above the conductive plate.

18 Claims, 9 Drawing Sheets

OTHER PUBLICATIONS

Gao, Steven (Shichang), et al., "Dual-Polarized Broad-Band Microstrip Antennas Fed by Proximity Coupling," IEEE Transactions On Antennas and Propagation, vol. 53, No. 1, Jan. 2005, pp. 526-530.

Ghorbani, K., et al., "Dual Polarized Wide-Band Antennas Aperture Stacked Antennas," IEEE Transactions On Antennas and Propagation, vol. 52, No. 8, Aug. 2004, pp. 2171-2174.

European Search Report, Application No. EP 08 10 3040.

European Search Report, Application No. EP 08 10 3040, Nov. 6, 2008.

* cited by examiner

COMPACT PLANAR ANTENNA FOR SINGLE AND MULTIPLE POLARIZATION CONFIGURATIONS

FIELD THE INVENTION

The invention pertains to antenna configurations. More particularly, the invention pertains to planar antennas with single or multiple polarizations.

BACKGROUND OF THE INVENTION

Slot or aperture-coupled planar patch antenna configurations are known for providing antennas having large frequency bandwidth. FIGS. 1A and 1B are an exploded perspective view and a cross-sectional elevation view of an exemplary slot-coupled patch antenna 100 of the prior art. The antenna comprises five major components, namely, a microstrip transmission feed line 103, a ground plane 105, a slot 104 in the ground plane, one or more radiating patches 107, 109 and a metallic cavity 117 (shown only in FIG. 1B). With reference to the Figures, a first substrate 101 has a transmission line 103 formed on one surface thereof and a ground plane 105 formed on the opposing surface. The substrate 101 may be any suitable dielectric substrate on which copper can be deposited or otherwise formed. Substrates typically used for printed circuit board (PCB) applications are suitable. The substrate 101 may be oriented so that the slot 104 is above the transmission line 103 or below it. Either configuration is acceptable as long as the transmission line and the slot are on opposing sides of the dielectric layer 101.

Disposed above the substrate 101 bearing the microstrip transmission line and slot is one or more patch antennas 107, 109. The patch antennas are disposed in additional substrates 111, 113. The patches also are copper layers deposited or otherwise formed on the surfaces of the substrates 111, 113. The substrates provide vertical spacing between each of the patches 107, 109 and between the patches and the slot 104 and transmission line 103. The terms vertical and horizontal as used herein are merely relative to each other and are not intended to connote absolute directions. As shown in FIG. 1A, the dielectric layers 111, 113 may comprise a plurality of layers 111*a*, 111*b*, . . . , 111*n* and 113*a*, . . . , 113*n* of conventionally available materials and thicknesses in order to provide the desired vertical distances between the patches, slot, and/or microstrip. The optimum vertical spacings between the microstrip feed line, slot, and patches depends on the desired operating characteristics of the antenna, including, for instance, center frequency, and/or bandwidth. Typically, another dielectric layer 115 will be placed above the topmost patch in order to safely enclose all of the operational components of the antenna (the layer or simply radome). In addition, below the layer 101 bearing the slot and the microstrip there must be a metallic cavity 117 having a depth $D_c$ equal to one-quarter wavelength of the center frequency of the antenna. The metallic cavity is shown in cross section in FIG. 1B but is omitted from FIG. 1A. In operation, energy is fed into the antenna 100 via microstrip transmission line 103. The energy electromagnetically couples from the microstrip 103 to the slot 104 on the opposite side of the substrate 101 and, therefrom, to the patches 107, 109.

The slot 104 radiates in both directions, i.e., up and down. The radiation headed in the down direction, i.e., away from the slots, would be lost in the absence of the metallic cavity 117. Furthermore, it likely would couple to and interfere with the operation of other antennas or circuits in the vicinity.

Particularly, these types of planar antennas typically are employed in arrays of multiple antennas in close proximity to each other.

Accordingly, the metallic cavity 117 is provided on the opposite side of the slot 104 from the patches 107, 109 and is about one quarter wavelength in depth. Particularly, the downwardly directed radiation from the slot 104 will be reflected back upwardly by the bottom surface 117*a* of the metallic cavity. This will prevent the radiation from escaping from the cavity and interfering with other antennas or circuits. Furthermore, the round trip from the slot to the reflecting surface back to the slot, therefore, is one-half wavelength. In addition, the metal reflecting surface at the bottom of the cavity provides another 180 degrees phase shift. Hence the total phase shift is 360° (or 0°) degrees. Accordingly, the reflected radiation will be in phase with the energy radiated from the slot at that moment so that the radiations will superpose with each other increasing the strength of the radiation in the upward direction toward the patches (i.e., the signals add constructively).

While this type of planar antenna has many good qualities, it also suffers from some significant disadvantages. Most notably, the requirement for a one-quarter wavelength metallic cavity causes the antenna to have a significant height. For instance, in a typical application for a planar antenna, such as an automotive application, cellular telephone, satellite radio, or space-based radar one quarter wavelength of typical operating microwave frequency of about 10 GHz would be 7.5 mm. This might render the design unsuitably tall for many applications, including automotive applications, where a low profile is important.

Accordingly, antenna designs have been developed that do not require a quarter wavelength metallic cavity. For instance, Wong, H. et al., *Design of Dual-Polarized L-Probe Patch Antenna Arrays With High Isolation*, IEEE Transactions on Antennas and Propagation, Vol. 52, No. 1, p. 45-52, January 2004 discloses an L-probe coupled patch antenna that can provide a large frequency bandwidth. FIGS. 2A and 2B are top and cross-sectional side views, respectively, of a dual-polarization L-probe antenna of this design. In a proximity coupled or L-probe antenna 200, there are no slots or metallic cavities. Rather, the end of the microstrip feed lines 201*a*, 201*b* are electrically connected by means of vertical vias 203*a*, 203*b* through one or more dielectric layers 205 (shown as air in FIG. 2B) to narrow horizontal probes 207*a*, 207*b* vertically spaced from the feed line in the direction of the patch(es), e.g., upwardly. The feed energy from the microstrip lines 201*a*, 20*ab* travels up the vias 203*a*, 203*b* and into the probes 207*a*, 207*b*. The probes 207*a*, 207*b* direct the feed energy upwardly from the feed line in the direction of the patch 211 to proximity couple to the patch. There is no downward radiation as there are no openings (like slots) in the ground plane of the antenna.

However, while proximity coupled or L-probe coupled antennas can be made thinner, they also have several significant drawbacks. First, they suffer from poor cross polarization. Furthermore, in the case of dual polarization antennas, the isolation between the two polarizations is very poor.

SUMMARY OF THE INVENTION

A planar antenna comprising a signal path for receiving or transmitting a signal, a conductive layer having a slot formed therein positioned to electromagnetically couple with the signal path, a conductive plate parallel to and overlying the slot and spaced therefrom by a dielectric layer, the conductive plate being electrically in contact with the signal path, and one or more patches parallel to and above the conductive plate.

DETAILED DESCRIPTION OF THE INVENTION

Figure 3A:
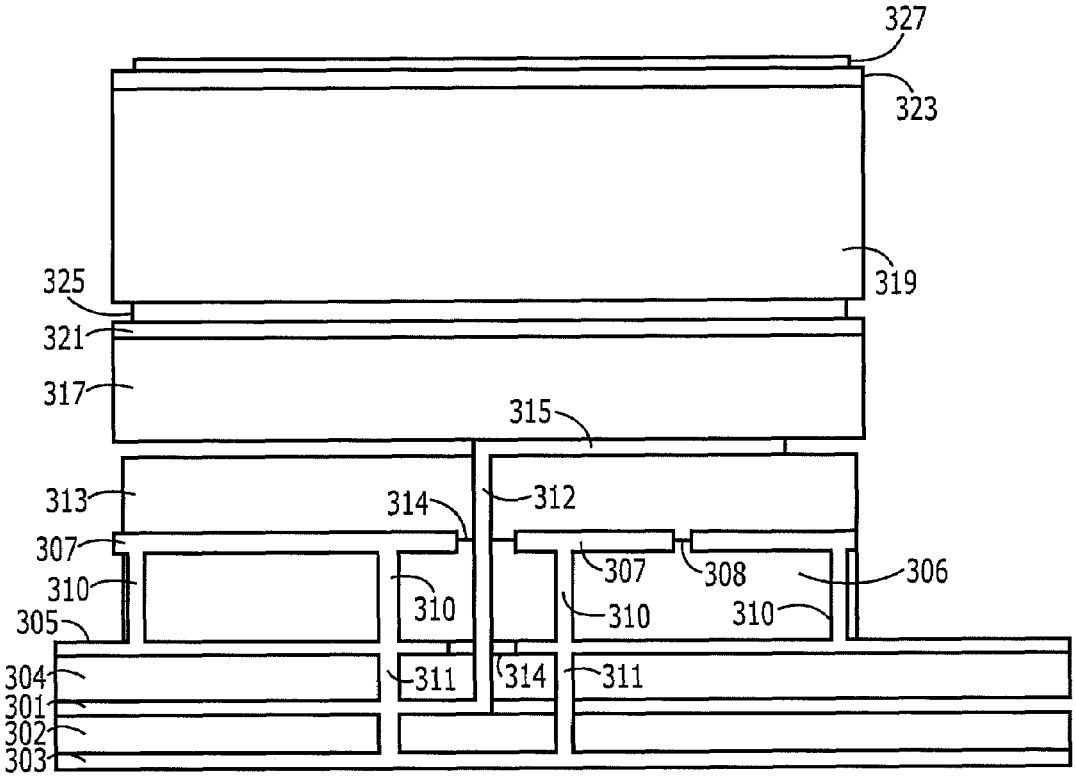
FIG. 3A is a cross-sectional elevation view of a planar antenna for a single polarization application in accordance with a first embodiment of the present invention.
Figure 3B:
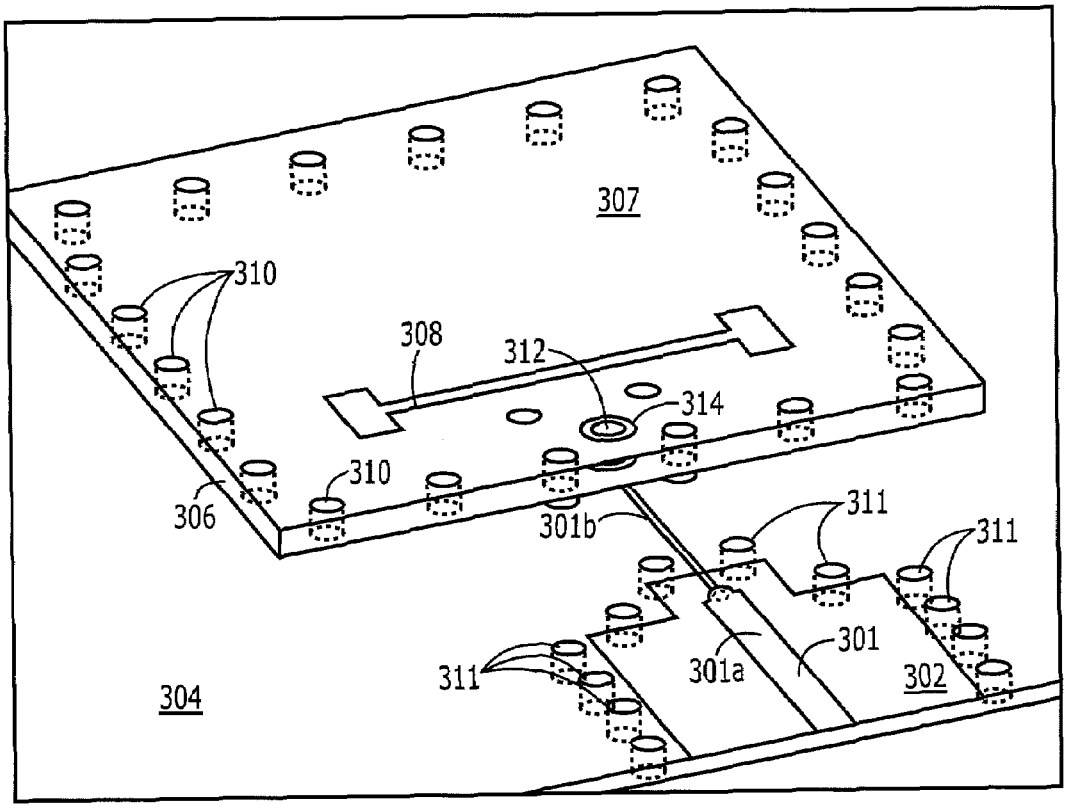
FIG. 3B is a transparent perspective view of some of the layers of the planar antenna in accordance with the first embodiment of the present invention illustrated in FIG. 3A.
Figure 3C:
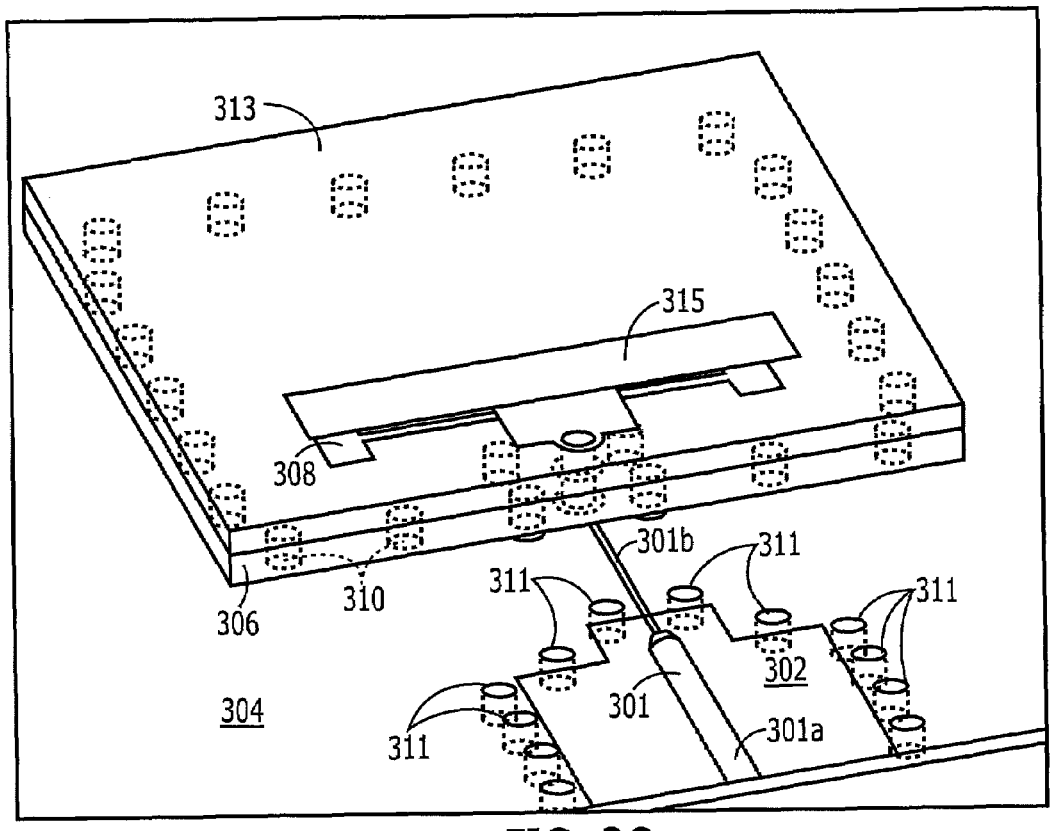
FIG. 3C is a partially transparent perspective view of the planar antenna in accordance with the first embodiment of the present invention illustrated in FIGS. 3A and 3B, but with additional structure and layers shown.
Figure 3D:
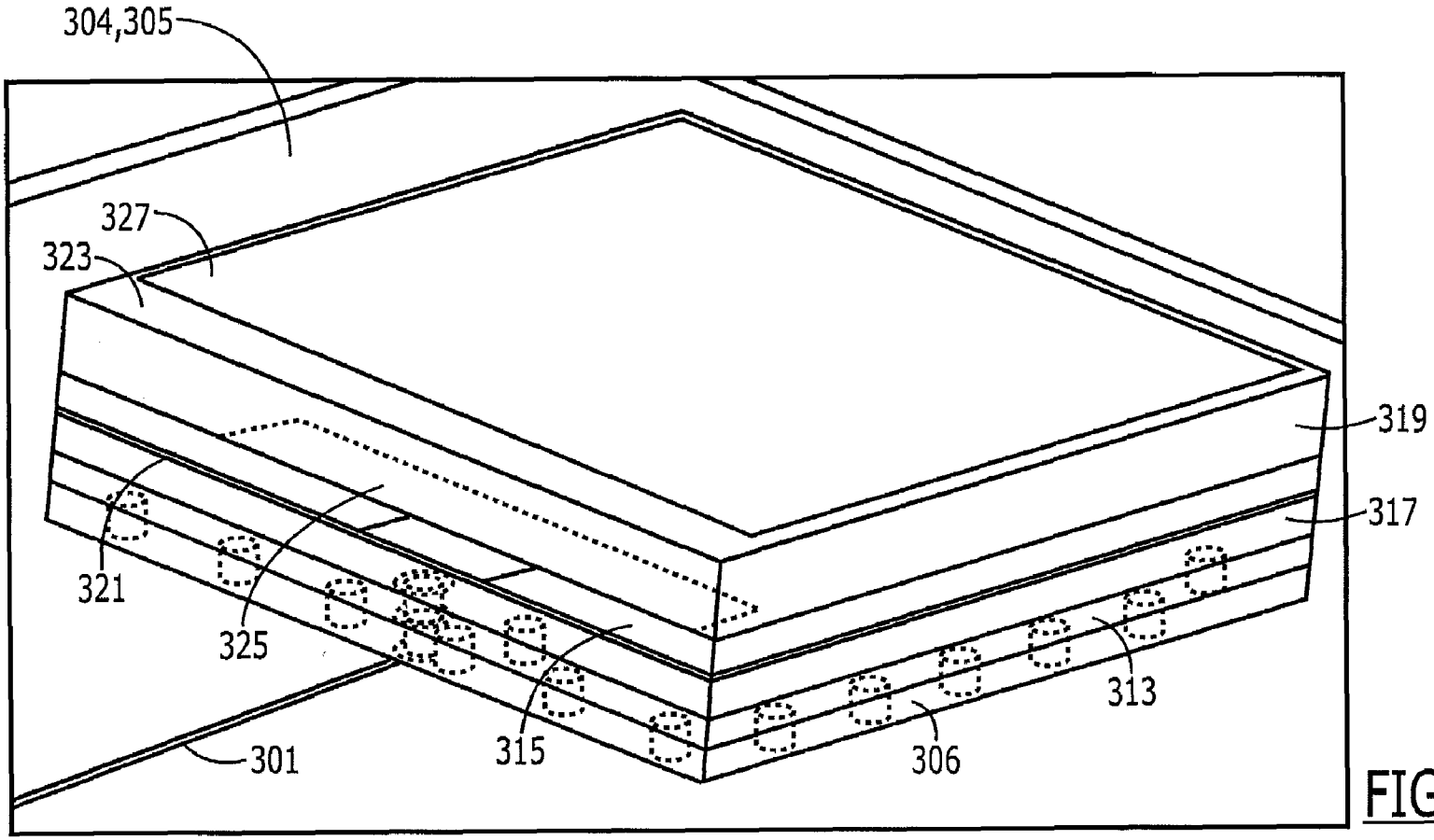
FIG. 3D is a partially transparent perspective view of the antenna of the first embodiment illustrated in FIGS. 3A, 3B, and 3C in a fully assembled state.
Figure 3E:
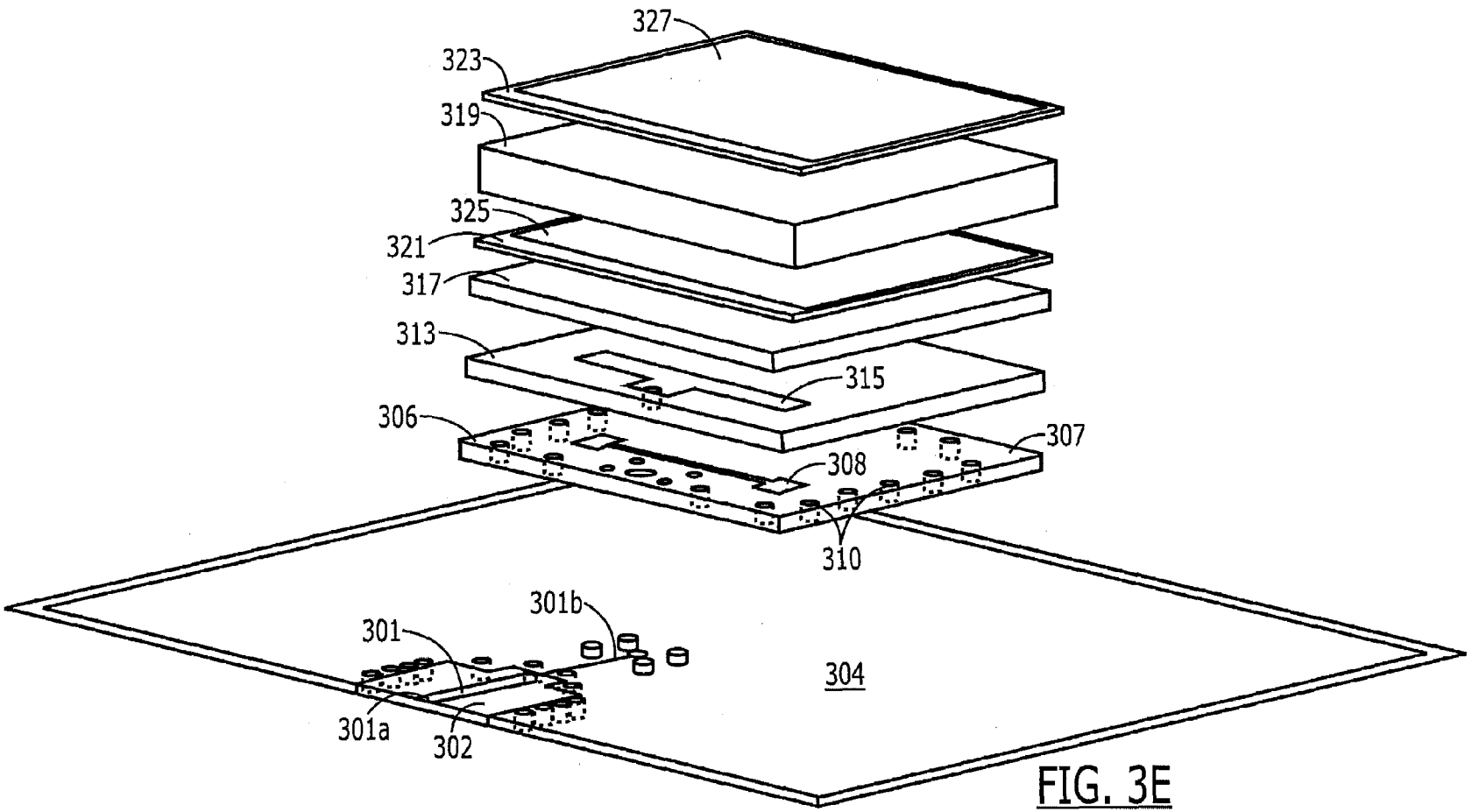
FIG. 3E is an exploded perspective view of the layers of the antenna of the first embodiment illustrated in FIGS. 3A-3D.

FIGS. 3A-3E are drawings of a first exemplary embodiment of the present invention. FIG. 3A is a cross sectional side view, FIG. 3B is a perspective view of some of the layers, FIG. 3C is a perspective view showing additional layers, FIG. 3D is a perspective view of the complete antenna showing all layers, and FIG. 3E is an exploded view of all of the layers of the antenna. With reference to FIGS. 3A and 3B first, a feed line in the form of a strip line 301 is provided. Alternatively, the antenna could be fed from the bottom by a coaxial input. The strip line 301 is sandwiched between two ground planes, namely, a lower ground plane 303 and an upper ground plane 305. More particularly, the strip line 301 is formed on the surface of a suitable thin dielectric substrate such as a 5 mil thick flex board 302 (or 304). The term flex board is used generically in the relevant industries to refer to a very thin (usually 1 to 5 mils thick) flexible dielectric board. One example is Pyralux AP™ substrate available from DuPont™. Flex board is merely an exemplary dielectric substrate that is suitable for the present application because it is very thin and, hence, light weight, and also flexible, but many other substrates can be employed. Most, if not all dielectric substrates commonly used in the fabrication of printed circuit boards (PCBs) can be used for any of the substrates discussed in connection with the present invention. Several exemplary substrates are discussed in the context of the various substrate layers in the following description. It should be understood that these are exemplary and not limiting. Furthermore, techniques for forming copper on all of the types of dielectric substrate discussed in this application, including flex board 302, are well known in the art.

A first ground plane, e.g., lower ground plane 303, is formed on the opposite side of the flex board 302 from the stripline 301. A second flex board 304 is positioned on top of the first flex board 302 such that the stripline 301 is sandwiched between the two flex boards 302, 304. On the opposite side of the second flex board 304 is the second ground plane 305. One or more vias 311 are formed through the flex boards 302, 304 to connect the two ground planes 303, 305 to each other. Again, techniques for creating a stack of dielectric substrates are well known in the art of printed circuit board fabrication. In one potential embodiment, the substrates are adhered to each other with a suitable adhesive (the adhesives are not shown in FIGS. 3A-3E).

As can best be seen in FIGS. 3B, 3C, and 3E, the feed line 301 actually starts out as a microstrip feed line 301*a*, i.e., with just one ground plane 303 on one side thereof and no overlying ground plane. It then becomes a strip line feed line 301*b*, i.e., having both an underlying ground plane 303 and an overlying ground plane 305. This is merely exemplary to illustrate the fact that the feed line may be a microstrip part of the way to the slot. Such a design might be desirable in some applications because it may make is easier to provide electrical connection(s) to the feed line. However, in alternate embodiments, the feed line may be formed entirely as a strip line and have no microstrip portion. (Any convenient way of feeding, such as microstrip, coaxial, or stripline can be used depending upon whether it is a single element antenna or a large antenna array).

The use of a strip line 301 sandwiched between two ground planes 303, 305 on either side of the strip line 301 prevents any undesired radiation emanating directly from the strip line from escaping into the surrounding volume and potentially interfering with adjacent antennas in an array. However, in a single element antenna or other embodiments in which such interference is not a concern, other feed mechanisms, such as a microstrip or coaxial feed line, may be preferable for their economics.

Another substrate 306, such as a TLY-5 substrate commercially available from Taconic Advanced Dielectric Division of Petersburgh, N.Y., USA, is positioned above the upper ground plane 305. As will be discussed in further detail below, this substrate in this particular embodiment forms the cavity for the radiating slot. Formed on the top side of the TLY-5 layer is a copper layer 307 with the radiating slot 308 form therein. At least one, but typically a plurality of vias 310 are formed (using any suitable known technique in the art) connecting the copper layer 307 to the upper ground plane 305. The slot 308 is separated from the upper ground plane 305 essentially by the thickness of the substrate layer 306 which defines the depth of the back cavity for the slot 308. The layer 306 does not need to be one quarter wavelength thick and can be of a thickness based on various electromagnetic optimization factors since the depth of the back cavity, i.e., the thickness of the layer 306, may have an effect on some operating parameters of the antenna. Hence, certain thicknesses may provide better overall optimization than others depending on the particular operating parameters of the antenna. In this particular embodiment, the TLY-5 layer 306 is 0.508 mm thick because this is a widely available thickness for TLY-5 and it is very thin and also provides desirable electromagnetic properties. At a typical 9.5 GHz center frequency, the cavity depth is about 0.508 mm which is about ⅛ of a wavelength.

Another dielectric layer 313 (shown in FIGS. 3A, 3C, 3D, and 3E) is positioned above the slot layer 306. In this exemplary embodiment, it is a layer of RO 4003, which is a woven glass-reinforced, ceramic-filled thermoset material commercially available from Rogers Corporation of Chandler, Ariz., USA which is another widely available and common substrate used in PCB fabrication. A wide conductive plate 315 is formed on the top surface of the RO4003 substrate 313 directly above the slot 308. As can best be seen in FIG. 3C, which is a partially transparent perspective view of the two flex layers 302, 304, the TLY5 layer 306, and the RO 4003 layer 313 (and the associated structures form therein), the plate 315 generally is formed to be approximately the same shape and size as the slot 308 so that it completely overlies the slot 308, but not much more of the dielectric layer 306.

A conductive via 312 is formed through the upper flex layer 304, the TLY5 layer 306, and the RO 4003 layer 313 between the end of the stripline 301 and the wide plate 315 providing a conductive path therebetween. Also, an opening 314 is provided in the copper forming the upper ground plane 305 as well as the copper forming the slot layer 307 (on the top surface of the TLY5 layer 306) so that the via 312 from the strip line 301 to the wide plate 315 is not in electrical contact with that copper layer.

Finally, one or more patches 325, 327 are provided above the wide plate 315. Of course, the patches will need to be formed in dielectric substrate layers, such as layers 321 and 323 that vertically separate the patches 325, 327 from each other and the patches from the wide plate 315. This separation can be provided by any suitable dielectric substrate, such as any of those typically used in PCB manufacturing. Alternately, it could be air or a vacuum. In the embodiment illustrated in FIGS. 3A-3E, lightweight and low cost foam layers 317,319 are used to provide most of the desired depth. Suitable dielectric substrates 321, 323 for forming the patches thereon (e.g., copper) are adhered to the top sides of the foam layers 317, 319. In this example, the substrate material is a very thin layer of RO4003. The copper patches 325, 327 are formed on the top sides of the RO4003 layers 321, 323.

As can be seen from the exemplary thicknesses provided in FIG. 3A, the cavity depth, i.e., the thickness of the TLY5 layer 306 that defines the depth of the back cavity is a mere 0.508 mm, which is approximately 0.017 times the wavelength of the center frequency of this particular antenna, namely, 9.5 GHz.

As illustrated in FIG. 3A, the overall height of this antenna is approximately 3.1 mm, excluding the ground plane structures.

The wide plate 315 that is positioned directly above and overlying the slot 308, acts as a director for the electromagnetic radiation emanating from the slot 308 in the direction of the plate 315, i.e., upwardly toward the patches 325, 327. Accordingly, a significant majority of the radiation is directed upwardly toward the patches rather than downwardly. Thus, there is no need for a quarter wavelength back cavity.

Figure 1B:
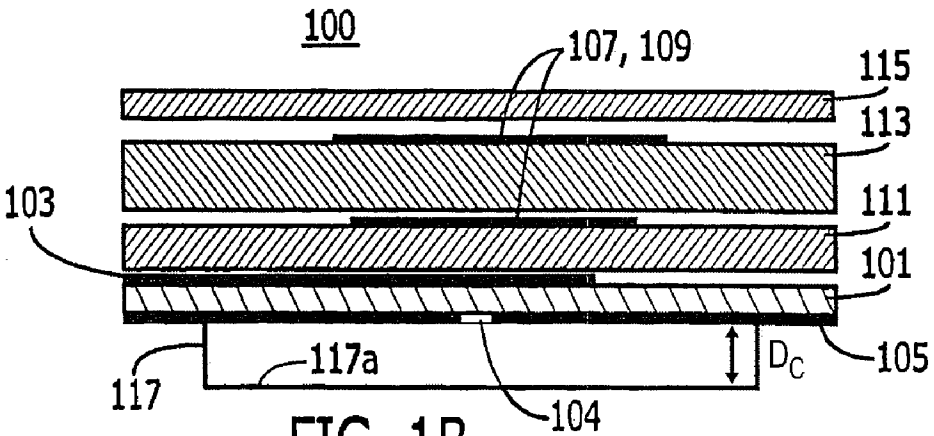
FIG. 1B (PRIOR ART)
FIG. 1B is a cross-sectional elevation view of the planar cavity back antenna of the prior art of FIG. 1A.
Figure 1A:
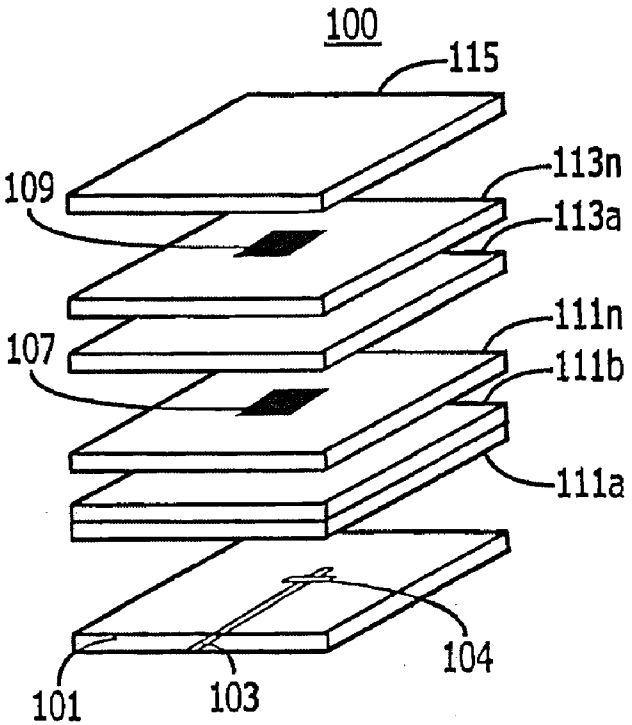
FIG. 1A (PRIOR ART)
FIG. 1A is an exploded, perspective view of a planar cavity back antenna of the prior art.
Figure 2A:
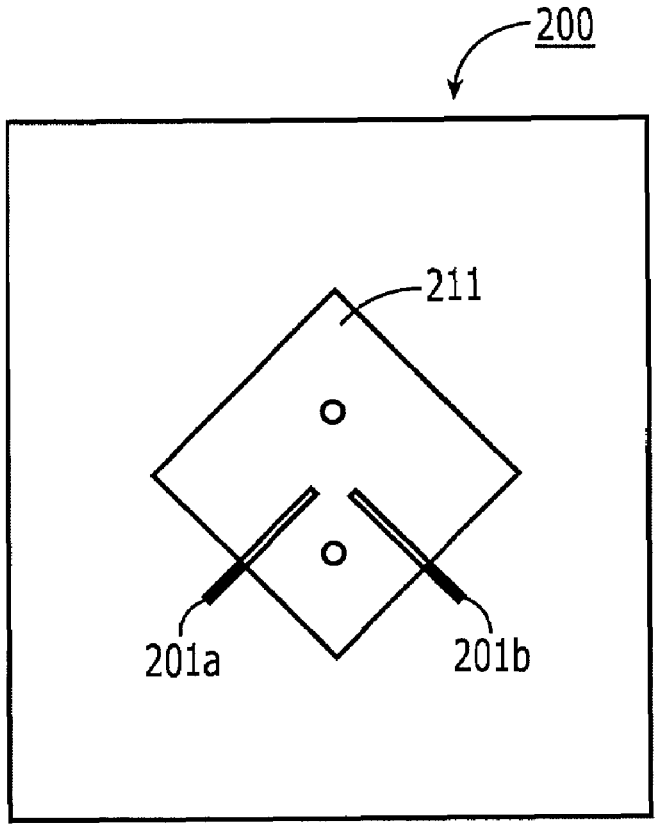
FIG. 2A (PRIOR ART)
FIGS. 2A and 2B are top plan and cross-sectional elevation views, respectively, of a dual polarization L-probe coupled antenna of the prior art.
Figure 2B:
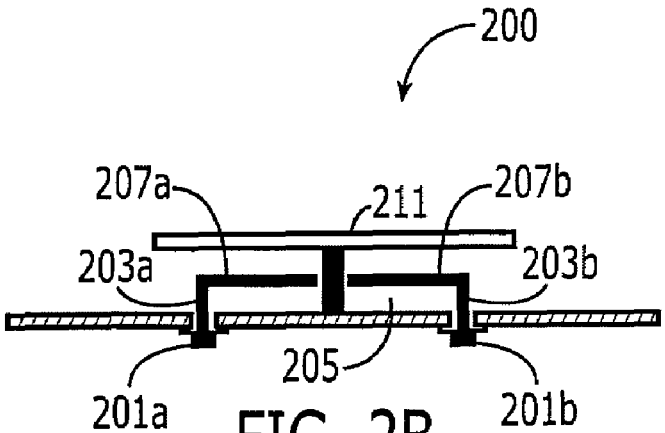
FIG. 2B (PRIOR ART)

This antenna has significant advantages over the prior art. For instance, it is much more compact than the cavity back antennas of the prior art illustrated in FIGS. 1A and 1B. Secondly, it can provide extremely wide bandwidth, on the order of 25% or greater. Furthermore, because it uses a slot, it has excellent cross polarization characteristics. Particularly, energy in the cross polarization direction, i.e., parallel to the length of the slot, is very small.

While the antenna has been described in connection with FIGS. 3A-3E as a radiating antenna, it should be readily apparent to those of skill in the art of planar antennas that the inventive concepts also can be applied to receiving antennas.

Figure 4A:
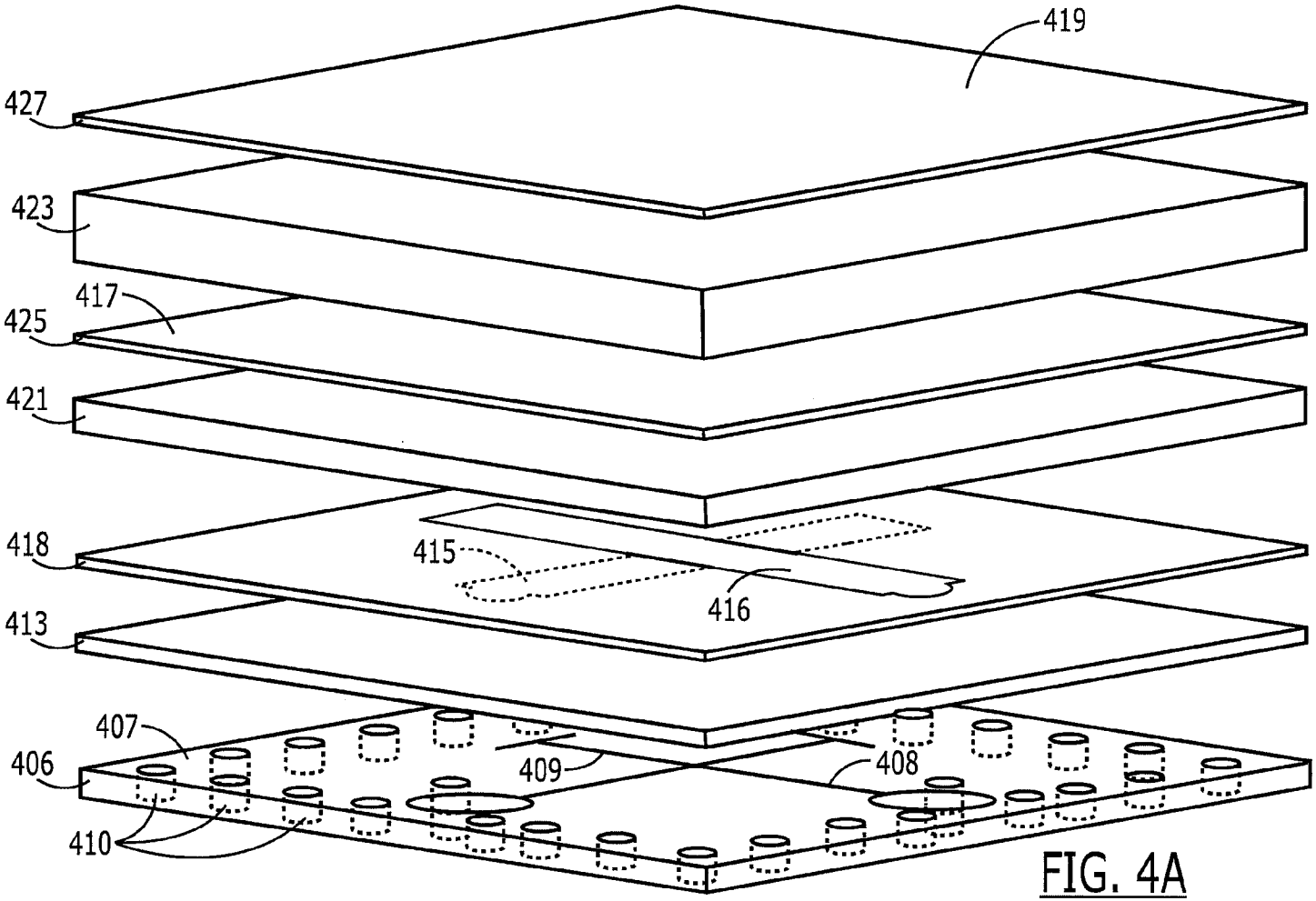
FIG. 4A is an exploded partially transparent perspective view of an exemplary dual polarization planar antenna in accordance with a second embodiment of the present invention.
Figure 4B:
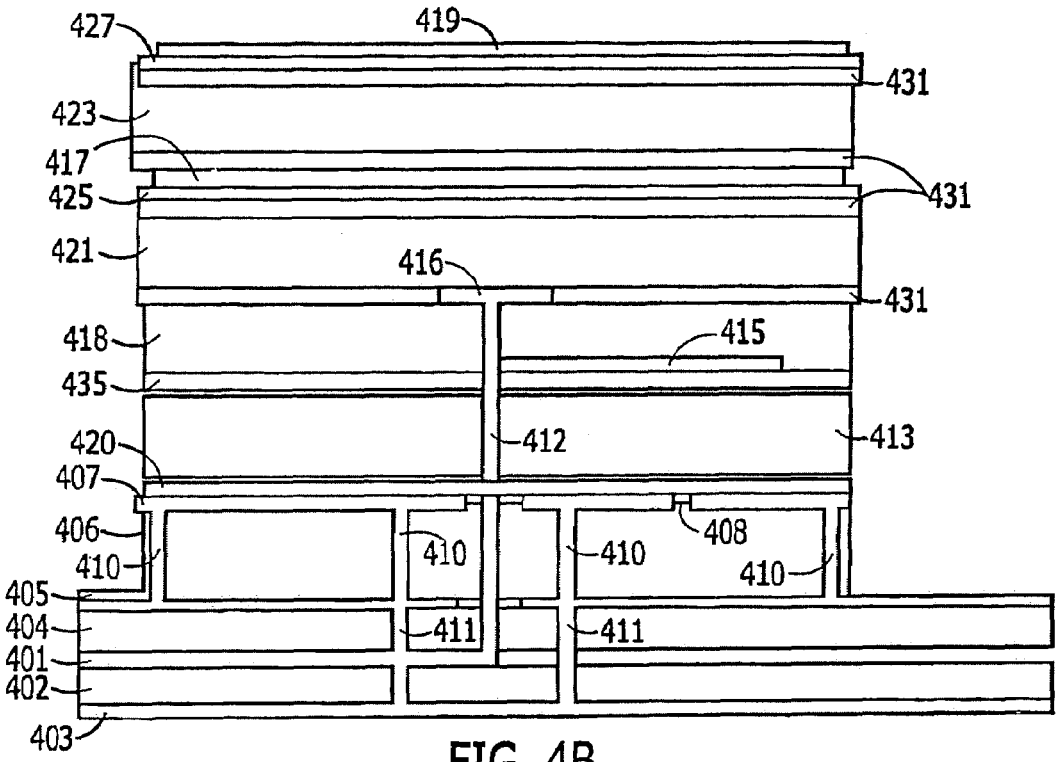
FIG. 4B is a cross-sectional elevation view of the dual polarization planar antenna of the second embodiment illustrated in FIG. 4A.

FIGS. 4A-4B illustrate a second embodiment of the invention, this embodiment being a dual polarization embodiment utilizing two orthogonal slots and, consequently, two orthogonal wide plates. More particularly, FIG. 4A is an exploded, partially transparent perspective view of the dual polarization antenna and FIG. 4B is a cross-sectional side elevation view of the antenna.

The strip line feeds 401, upper and lower ground planes 403, and 405, and flex boards 402, 404 are essentially the same as in the previous embodiment except that there are two stripline feeds in the case of a dual-polarized antenna and are illustrated only in FIG. 4B for sake of completeness. Also, adhesive layers, i.e., layers 416 and 431 discussed below, are shown only in the side view of FIG. 4B in order not to unduly complicate the perspective view of FIG. 4A, and, in fact, only one of the feeds 401 can be seen in the particular cross-section taken in FIG. 4B. Particularly, as in the previously described embodiment of FIGS. 3A-3E, the feed strip lines 401 are sandwiched between two layers of dielectric 402, 404, such as 5 mil thick flex board having copper ground planes 403, 405 formed on their sides opposite the strip line 401. Again, there are one or more vias 411 passing through the two flex layers 402, 404 connecting the upper and lower ground planes 403, 405 to each other.

Another dielectric layer 406, such as a TLY-5 layer, is adhered to the top side of the top ground plane 405. Another plurality of vias 410 run through the thickness of the TLY-5 layer 406 connecting the upper ground plane 405 to the copper 407 formed on top of the TLY-5 layer. In a preferred embodiment, a series of vias 410 run around the periphery of the TLY-5 layer.

Two orthogonal slots 408, 409 are formed in the copper layer 407 on top of the TLY-5 layer 406, as best seen in FIG. 4A.

An adhesive layer 420 of 4 mil RO4450 is placed on top of the copper layer 407 bearing the orthogonal slots 408, 409 for adhering a thicker layer 413 of RO4003 to the TLY-5 layer 406. Another thin layer 435 of RO4450 adhesive is bonded to the top side of RO4003 layer 413 for adhering another layer 418 of TLY-5 thereto. Two plates 415, 416 are disposed overlying the two slots 408, 409, respectively, with one plate 415 overlying the first slot 408 and the other plate 416 overlying the second slot 409, as best shown in FIG. 4A. These two plates are not physically connected together at any point. More particularly, the two plates 415, 416 may be formed on opposite sides of the second TLY-5 layer 418. This construction is merely exemplary. Alternately, for instance, plate 415 could be formed on the top surface of RO4450 layer 435 or even on the top surface of RO4003 layer 413. Also, plate 416 could be formed on the bottom surface of the next overlying layer. Finally, one or more patches are provided on top of the wide plates 415, 416 and spaced therefrom by suitable dielectric layers. In the illustrated embodiment, two patches 417, 419 are provided. Each patch is formed on top of a very thin layer (0.100 mm) of Arlon 25N 425, 427. The Arlon 25N layers 425, 427 are themselves adhered by adhesive layers 431 (shown only in FIG. 4B) to foam layer 421, 423 of suitable thickness for the particular operating parameters of the antenna. Another adhesive layer 431 adheres the bottom of the upper foam layer 423 to the top of the lower copper, patch 417.

Note from the exemplary depths of the layers provided in FIG. 4B that this antenna is a mere 2 mm in total height, which is 0.063 times the operating wavelength of this particular design, which is 31.6 mm (i.e. an operating frequency of 9.5 GHz).

Simulations show that this antenna should have a bandwidth of approximately 25%. Also, it is estimated that this exemplary antenna would weigh approximately 0.4 grams with the exemplary materials and assuming horizontal dimensions of 12 mm×12 mm. Thus, this antenna would be an ideal lightweight antenna for space-based radars, where hundreds or even thousands of such antenna elements are used in antenna arrays.

The two the slots 408, 409 are orthogonal to each other and, hence, the two plates 415, 416 that cover the slots also are orthogonal to each other. This antenna provides excellent isolation between the polarizations of the two slots. Particularly, the wide plates overlying the two coplanar planar slots on opposite sides of the TLY5 layer provide excellent isolation between the two polarization modes.

Having thus described a few particular embodiments of the invention, various alterations, modifications, and improvements will readily occur to those skilled in the art. Such alterations, modifications and improvements as are made obvious by this disclosure are intended to be part of this description though not expressly stated herein, and are intended to be within the spirit and scope of the invention. Accordingly, the foregoing description is by way of example only, and not limiting. The invention is limited only as defined in the following claims and equivalents thereto.

The invention claimed is:

1. A planar antenna comprising:

a signal path layer having a signal path for carrying a signal;

a conductive layer parallel to the signal path layer having a slot formed therein positioned above the signal path to electromagnetically couple energy to or from the signal path;

a conductive plate parallel to and above said slot and vertically spaced from said slot by a first dielectric layer, said conductive plate in electrically conductive contact with said signal path; and an antenna patch parallel to and above said conductive plate.

2. The planar antenna of claim 1 wherein said conductive plate is substantially similar in shape and size to said slot.

3. The planar antenna of claim 2 wherein said antenna patch comprises a plurality of patches parallel and vertically spaced from each other and wherein said patches are substantially greater in area than said conductive plate and said slot.

4. The planar antenna of claim 2 wherein said slot comprises first and second perpendicular slots and wherein said conductive plate comprises first and second perpendicular conductive plates.

5. The planar antenna of claim 4 wherein said first and second slots are coplanar and said first and second conductive plates are not coplanar.

6. The planar antenna of claim 5 wherein said first and second conductive plates are formed on opposite sides of a dielectric substrate.

7. The planar antenna of claim 1 wherein said slot has a length and a width, said length being greater than said width, and wherein said conductive plate is at least as wide as said slot.

8. The planar antenna of claim 1 wherein said slot has a length and a width, said length being greater than said width, and wherein said conductive plate is about three to four times as wide as said slot.

9. The planar antenna of claim 1 wherein said signal path comprises a strip line parallel and vertically spaced from said conductive layer having said slot.

10. The planar antenna of claim 9 wherein said strip line comprises a transmission line sandwiched between an upper ground plane and a lower ground plane.

11. The planar antenna of claim 10 wherein said strip line is vertically spaced from said slot by substantially less than ¼ of a wavelength of a center frequency of said planar antenna.

12. The planar antenna of claim 10 wherein said slot is vertically spaced from said upper ground plane by substantially less than ¼ of a wavelength of a center frequency of said planar antenna.

13. The planar antenna of claim 10 further comprising a plurality of conductive vias conductively connecting said upper ground plane to said lower ground plane.

14. The planar antenna of claim 1 wherein said first dielectric layer is formed of a printed circuit board material.

15. The antenna of claim 1 wherein said first dielectric layer is formed of air.

16. The planar antenna of claim 1 wherein said conductive plate is coupled to said signal path by a conductive via through said first dielectric layer.

17. The planar antenna of claim 1 further comprising a second dielectric layer vertically separating said antenna patch from said conductive plate, said second dielectric layer comprising a foam layer.

18. The planar antenna of claim 1 wherein said conductive plate acts as a director of energy emanating from said slot in the direction of said patch.

* * * * *